US009484167B2

(12) United States Patent
Baek

(10) Patent No.: US 9,484,167 B2
(45) Date of Patent: Nov. 1, 2016

(54) COUPLING DEVICE FOR CIRCUIT BREAKER

(71) Applicant: LSIS CO., LTD., Anyang-si, Gyeonggi-do (KR)

(72) Inventor: Ki Ho Baek, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 95 days.

(21) Appl. No.: 14/226,501

(22) Filed: Mar. 26, 2014

(65) Prior Publication Data

US 2014/0346021 A1 Nov. 27, 2014

(30) Foreign Application Priority Data

May 21, 2013 (KR) ..... 10-2013-0057370

(51) Int. Cl.

| | |
|---|---|
| ***H01H 25/06*** | (2006.01) |
| ***H01H 19/14*** | (2006.01) |
| ***H01H 71/10*** | (2006.01) |
| *H01H 3/10* | (2006.01) |

(52) U.S. Cl.

CPC ..... *H01H 19/14* (2013.01); *H01H 71/1018* (2013.01); *H01H 2003/105* (2013.01)

(58) Field of Classification Search

CPC ..... H01H 13/08; H01H 2003/105; H01H 25/06; H01H 3/10; H01H 13/20

USPC ..... 200/337, 338, 6 A

See application file for complete search history.

(56) References Cited

U.S. PATENT DOCUMENTS

| | | | | |
|---|---|---|---|---|
| 2,157,996 A * | 5/1939 | Brownstein | ..... | F16D 3/68 464/149 |
| 2,502,790 A | 4/1950 | Jencick | | |
| 2012/0208649 A1 * | 8/2012 | Nakagawa | ..... | F16D 3/68 464/73 |

FOREIGN PATENT DOCUMENTS

| | | |
|---|---|---|
| CN | 102639892 | 8/2012 |
| DE | 1805220 | 5/1970 |
| DE | 2439558 | 2/1976 |
| EP | 1416180 | 5/2004 |
| FR | 2701593 | 8/1994 |

(Continued)

OTHER PUBLICATIONS

Japan Patent Office Application Serial No. 2014-078720, Office Action dated Jan. 6, 2015, 3 pages.

European Patent Office Application Serial No. 14162555.8, Search Report dated Sep. 29, 2014, 6 pages.

(Continued)

*Primary Examiner* — Renee Luebke
*Assistant Examiner* — Ahmed Saeed
(74) *Attorney, Agent, or Firm* — Lee, Hong, Degerman, Kang & Waimey

(57) ABSTRACT

Disclosed is a coupling device for a circuit breaker. A third coupler formed as a curved surface is provided between a first coupler coupled to an outer handle assembly, and a second coupler coupled to an inner handle. Under such configuration, even if the inner handle and the outer handle assembly are not concentric with each other, the third coupler may transmit a rotational force applied to the first coupler to the second coupler in a direction perpendicular to a shaft direction of the second coupler, in a state where the third coupler is inclined from an upper surface of the circuit breaker body. As a result, a user's force to rotate the outer handle can be transmitted to the inner handle. This can prevent a malfunction of the circuit breaker, and thus can enhance reliability of the circuit breaker.

7 Claims, 8 Drawing Sheets

(56) References Cited

FOREIGN PATENT DOCUMENTS

| | | |
|---|---|---|
| FR | 2784148 | 4/2000 |
| GB | 1365760 | 9/1974 |
| JP | 49-111654 U | 1/1973 |
| JP | 48-41171 | 12/1973 |
| JP | 49-111654 | 9/1974 |
| JP | 10-069845 | 3/1998 |
| JP | 2008-159503 | 7/2008 |
| JP | 2011-102610 | 5/2011 |
| JP | 2014-078720 | 5/2014 |

OTHER PUBLICATIONS

The State Intellectual Property Office of the People's Republic of China Application Serial No. 201410217324.0, Office Action dated Oct. 30, 2015, 8 pages.

Japan Patent Office Application Serial No. 2014-078720, Office Action dated Jan. 5, 2016, 3 pages.

State Intellectual Property Office of the People's Republic of China Application Serial No. 201410217324.0, Office Action dated Jun. 22, 2016, 9 pages.

* cited by examiner

COUPLING DEVICE FOR CIRCUIT BREAKER

CROSS-REFERENCE TO RELATED APPLICATION

Pursuant to 35 U.S.C. §119(a), this application claims the benefit of earlier filing date and right of priority to Korean Application No. 10-2013-0057370, filed on May 21, 2013, the contents of which is incorporated by reference herein in its entirety.

BACKGROUND OF THE DISCLOSURE

1. Field of the Disclosure

The present disclosure relates to a coupling device for a circuit breaker, and particularly, to a coupling device for a circuit breaker, which is provided between an outer handle assembly and an inner handle mechanism.

2. Background of the Disclosure

Generally, a circuit breaker is an apparatus capable of breaking an electric circuit in order to protect the electric circuit, when an overload or a short circuit has occurred. The circuit breaker has a function to switch on/off a load in order to connect/disconnect an electric circuit, when an abnormal current such as an overload and a short circuit has occurred. Switching on/off a load is performed by a mechanical operation.

A circuit breaker body is installed at an inner space of a distribution board. An outer handle assembly, which includes an outer handle and which is configured to control an on/off operation of the circuit breaker body, is installed outside the distribution board.

The outer handle assembly is a device installed at a distribution board panel, and manipulated by a user from outside so as to control the circuit breaker.

The outer handle assembly allows an operation of the circuit breaker to be smoothly transmitted to outside of the distribution board panel. On the contrary, the outer handle assembly allows a force applied from outside, to be smoothly transmitted to the circuit breaker.

FIG. 1 is a disassembled perspective view of a circuit breaker and an outer handle assembly in accordance with the conventional art, FIG. 2 is a longitudinal sectional view illustrating a connection part of the circuit breaker and the outer handle assembly of FIG. 1, and FIG. 3 is a longitudinal sectional view illustrating an assembled state of the circuit breaker and the outer handle assembly of FIG. 2.

Referring to FIG. 1, the conventional circuit breaker includes a circuit breaker body 1 installed in a distribution board; an inner handle 2 rotatably installed at the circuit breaker body 1, and configured to manipulate the circuit breaker; and an outer handle assembly 10 installed at a distribution board panel 5 so as to manipulate the inner handle 2, and connected to the inner handle 2.

The outer handle assembly 10 includes a cover 11 installed at the distribution board panel 5; an outer handle 12 rotatably installed at the cover 11, and manipulated by a user from outside of the distribution board panel 5; and a shaft 13 connected to the outer handle 12, and configured to transmit an operation of the outer handle 12 to the inner handle 2.

A coupling assembly 20, configured to transmit a rotational force of the outer handle assembly 10 to the inner handle 2, is coupled between the outer handle assembly 10 and the inner handle 2.

The coupling assembly 20 includes a first coupler 21 coupled to the shaft 13; a second coupler 22 coupled to the inner handle 2; a coupling spring 23 disposed between the first coupler 21 and the second coupler 22, and configured to allow the first coupler 21 and the second coupler 22 to be positioned on the same shaft; and a coupling bolt 24 configured to couple the first coupler 21 and the second coupler 22 to each other.

A key portion 21*a* is formed at a center of one side surface of the first coupler 21. A key groove portion 22*a*, configured to insert the key portion 21*a* of the first coupler 21 and configured to transmit a rotational force applied to the first coupler 21 through the shaft 13 to the second coupler 22, is formed at a center of one side surface of the second coupler 22 in correspondence to the key portion 21*a* of the first coupler 21.

If a user rotates the outer handle 12 in a state where the circuit breaker and the outer handle assembly 10 have been assembled to each other, a rotational force of the outer handle 12 is transmitted to the shaft 13 and the first coupler 21. Then the rotational force is transmitted to the inner handle 2 by the key portion 21*a* of the first coupler 21 and the key groove portion 22*a* of the second coupler 22, thereby being used to turn on/off the circuit breaker.

However, the conventional circuit breaker may have the following problems.

Considering an assembly tolerance which may occur between the outer handle assembly 10 and the inner handle 2, it is required to have a gap between the key portion 21*a* of the first coupler 21 and the key groove portion 22*a* of the second coupler 22. However, in a case where the outer handle assembly 10 is not concentric with the inner handle 2, the first coupler 21 and the second coupler 22 of the coupling assembly 10 are not concentric with each other as shown in FIG. 3. This may cause the key portion 21 to be partially detached from the key groove portion 22*a*. As a result, a rotational force of the outer handle assembly 10 may not be precisely transmitted to the inner handle 2. This may lower reliability of the circuit breaker.

SUMMARY OF THE DISCLOSURE

Therefore, an aspect of the detailed description is to provide a coupling device for a circuit breaker, capable of precisely transmitting a rotational force of an outer handle assembly to an inner handle, even if the outer handle assembly and the inner handle are not concentric with each other.

To achieve these and other advantages and in accordance with the purpose of this specification, as embodied and broadly described herein, there is provided a coupling device for a circuit breaker, comprising: an outer handle assembly installed outside a distribution board having a circuit breaker body; an inner handle rotatably installed at the circuit breaker body, and configured to manipulate a circuit breaker; and a coupling assembly installed between the outer handle assembly and the inner handle, and configured to transmit a rotational force of the outer handle assembly to the inner handle, wherein the coupling assembly includes a first coupler coupled to the outer handle assembly; a second coupler coupled to the inner handle, and restricted by the first coupler in a shaft direction; and a third coupler coupled between the first coupler and the second coupler, and configured to transmit a rotational force applied to the first coupler to the second coupler.

Even if the inner handle and the outer handle assembly are not concentric with each other, the third coupler may transmit a rotational force applied to the first coupler to the second coupler in a direction perpendicular to a shaft direction of the second coupler, in a state where the third coupler is inclined from an upper surface of the circuit breaker body. As a result, a user's force to rotate the outer handle can be transmitted to the inner handle. This can prevent a malfunction of the circuit breaker, and thus can enhance reliability of the circuit breaker.

One or more first coupling protrusions, which protrude from the outer handle assembly in a shaft direction, may be formed at the first coupler. One or more second coupling protrusions, which protrude from the outer handle assembly in a shaft direction in correspondence to the first coupling protrusions, may be formed at the second coupler. The third coupler may be inserted between the first coupling protrusion and the second coupling protrusion.

An overlapped length between the first coupling protrusion and the second coupling protrusion in a shaft direction may be longer than a contact length between the first coupling protrusion or the second coupling protrusion and the third coupler in a shaft direction.

The third coupler may include: a body portion provided at an inner side of an inner circumferential surface of the first coupling protrusion and the second coupling protrusion; and a plurality of sliding protrusions radially protruding from an outer circumferential surface of the body portion, each sliding protrusion disposed between a side surface of the first coupling protrusion in a circumferential direction and a side surface of the second coupling protrusion in a circumferential direction, and configured to transmit a rotational force applied to the first coupler to the second coupler, wherein two side surfaces of the sliding protrusion in a circumferential direction, which contact the side surface of the first coupling protrusion in a circumferential direction and the side surface of the second coupling protrusion in a circumferential direction, are formed as curved surfaces.

The two side surfaces of the sliding protrusion in a circumferential direction may be formed in an oval shape having a long axis and a short axis.

A coupling spring, configured as a compression coil spring, may be provided between the first coupler and the second coupler. The coupling spring may be inserted into the third coupler.

A height of the sliding protrusion in a shaft direction may be higher than that of the first coupling protrusion or the second coupling protrusion in a shaft direction.

The two side surfaces of the sliding protrusion in a circumferential direction may be formed to point-contact the first coupling protrusion and the second coupling protrusion in a radius direction.

The side surface of the first coupling protrusion or the second coupling protrusion in a circumferential direction, which contacts the side surface of the sliding protrusion in a circumferential direction, may be formed to have a curved surface.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a coupling device for a circuit breaker according to the present invention will be explained in more detail with reference to the attached drawings.

Figure 1:
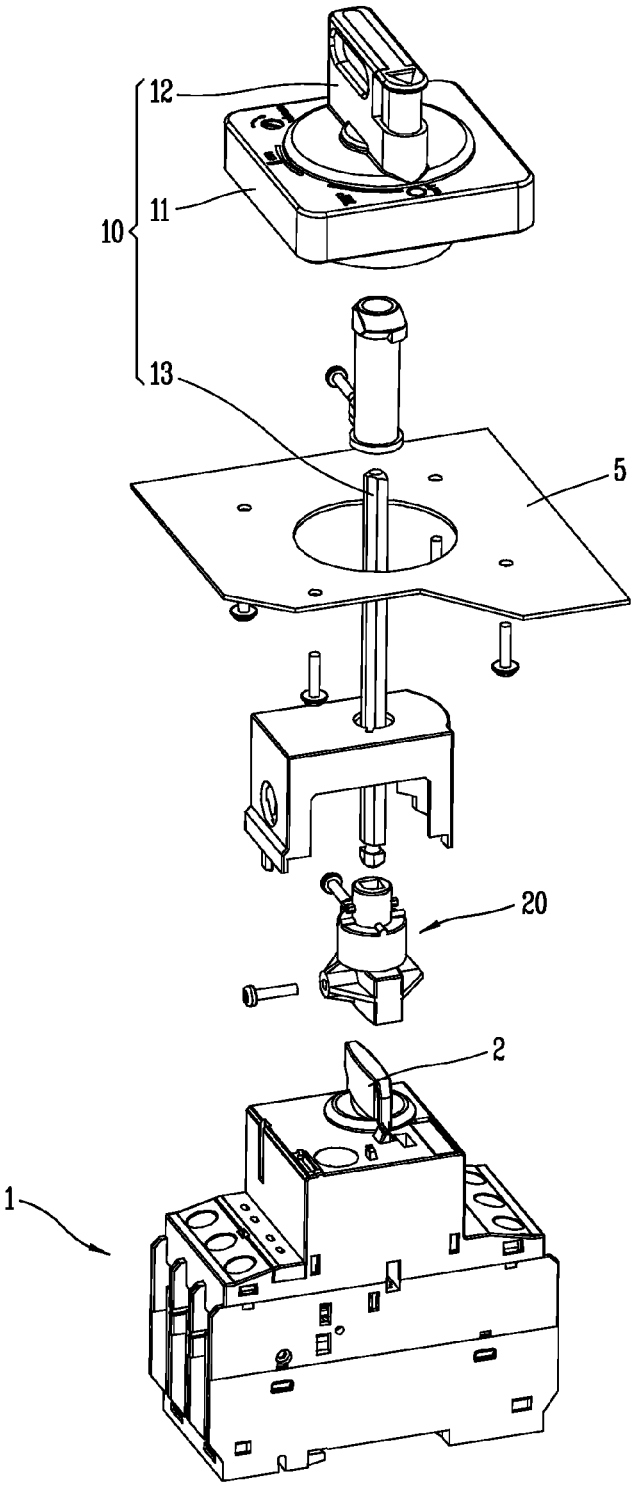
FIG. 1 CONVENTIONAL ART
FIG. 1 is a disassembled perspective view of a circuit breaker and an outer handle assembly in accordance with the conventional art.
Figure 2:
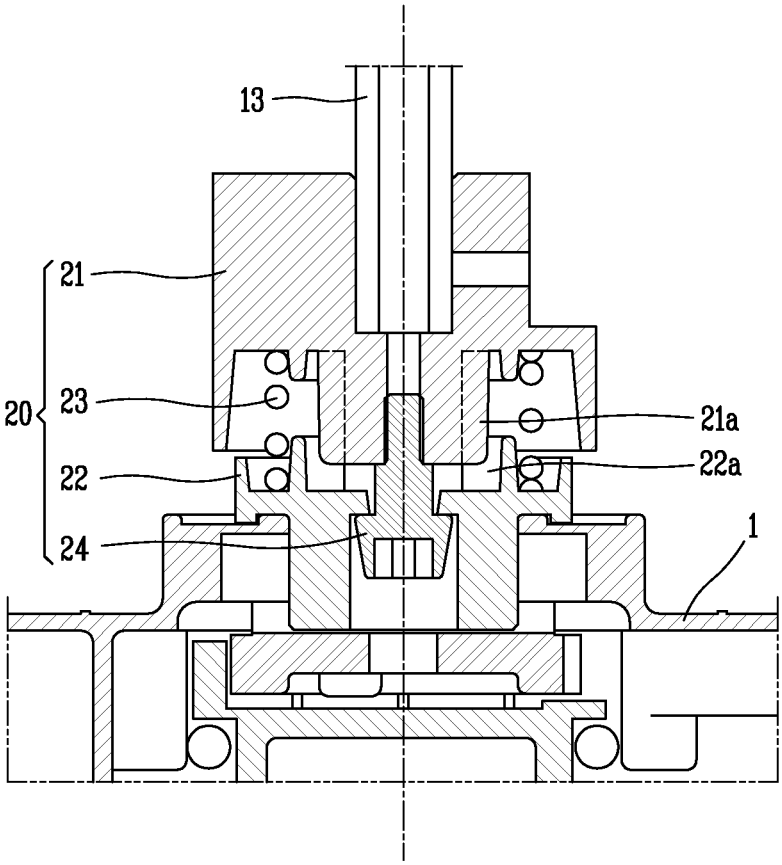
FIG. 2 CONVENTIONAL ART
FIG. 2 is a longitudinal sectional view illustrating a connection part of the circuit breaker and the outer handle assembly of FIG. 1.
Figure 3:
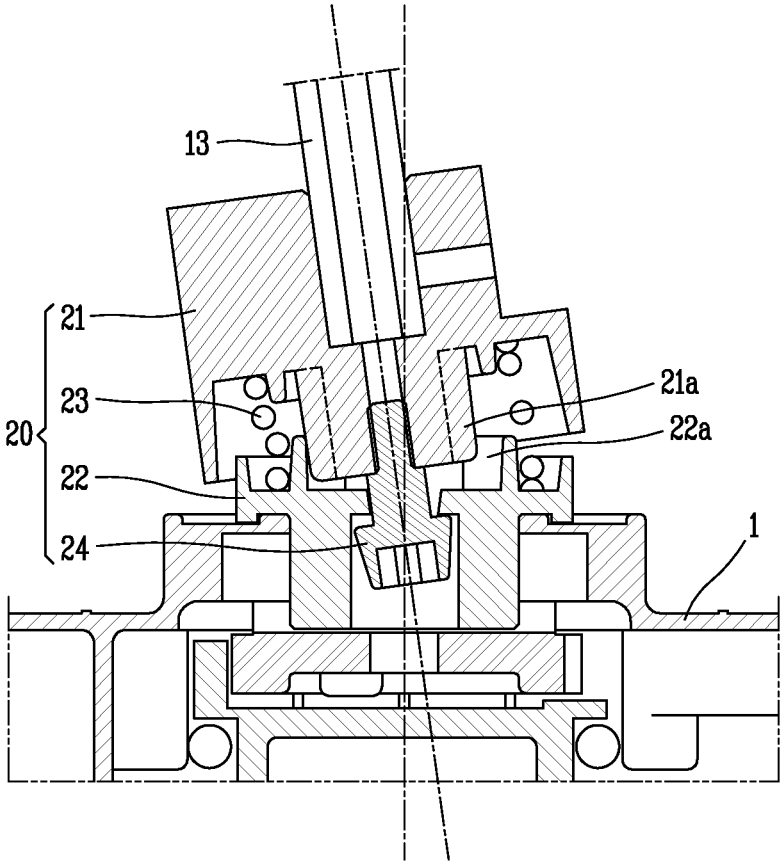
FIG. 3 CONVENTIONAL ART
FIG. 3 is a longitudinal sectional view illustrating an assembled state of the circuit breaker and the outer handle assembly of FIG. 2.
Figure 4:
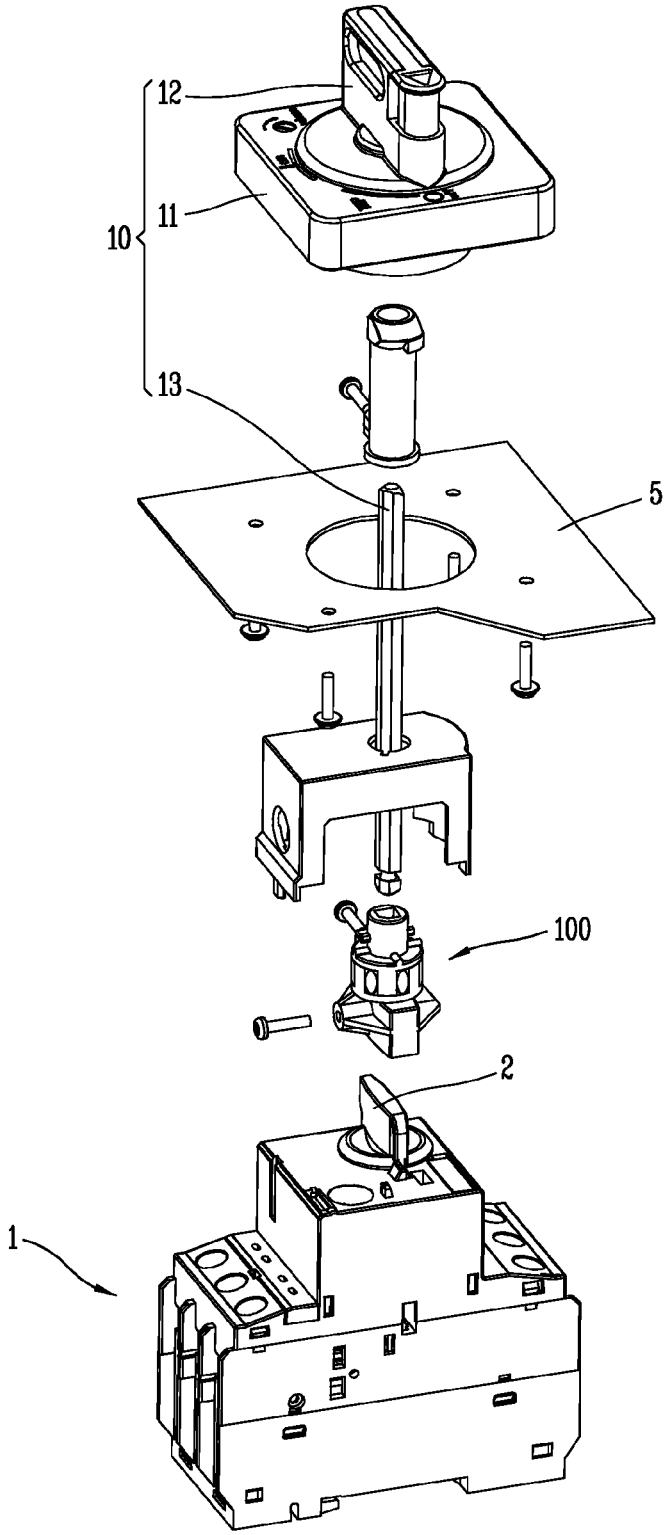
FIG. 4 is a disassembled perspective view of a circuit breaker and an outer handle assembly according to the present invention.
Figure 5:
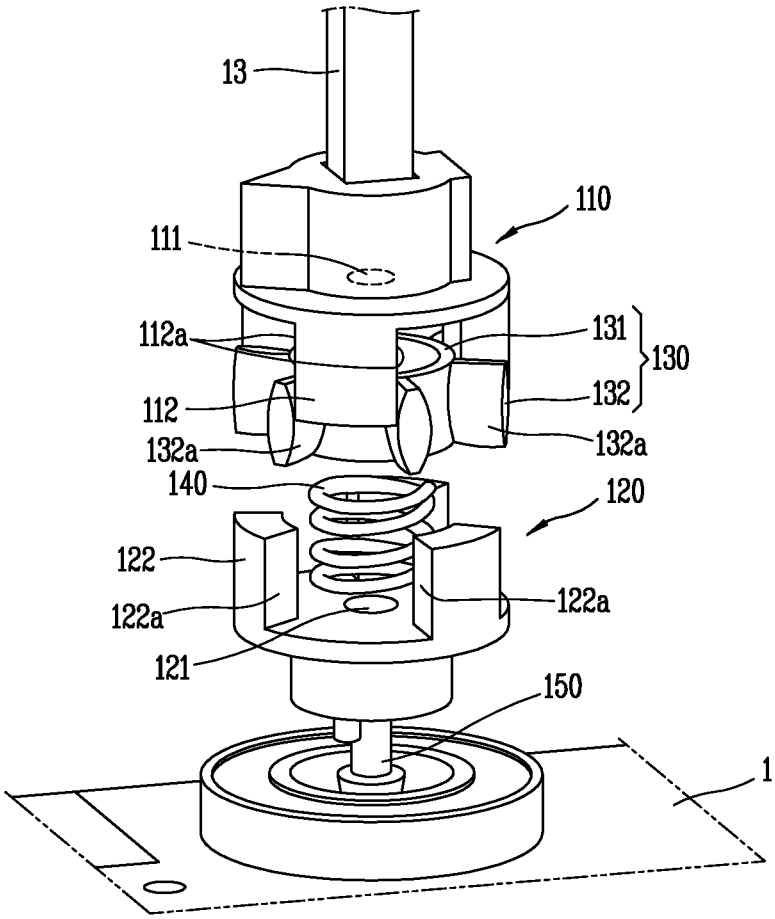
FIG. 5 is a disassembled perspective view of a coupling assembly of the circuit breaker of FIG. 4.
Figure 6:
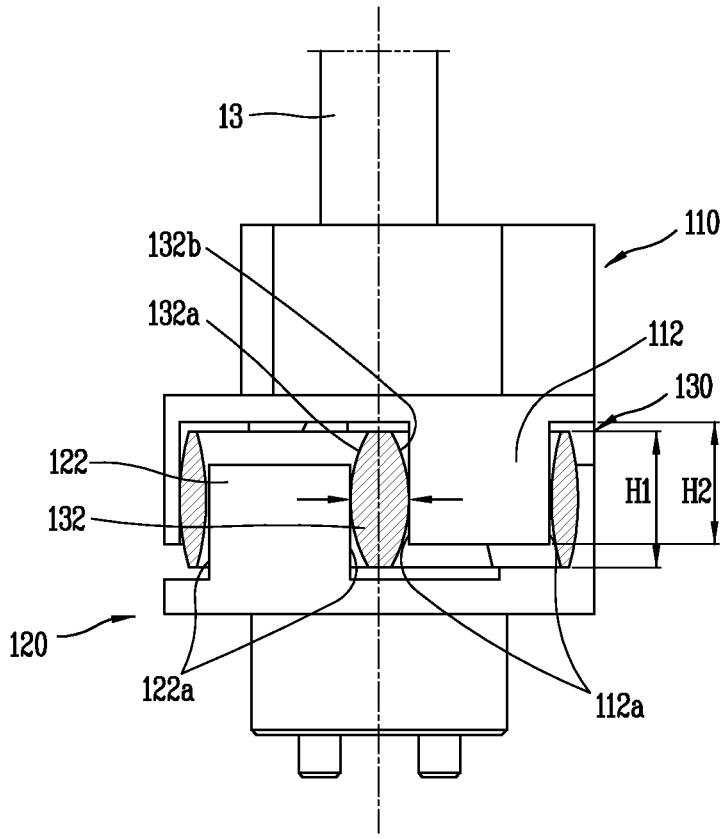
FIG. 6 is a longitudinal sectional view illustrating an assembled state of a coupling assembly in a case where an inner handle and an outer handle assembly of FIG. 5 are concentric with each other.
Figure 7:
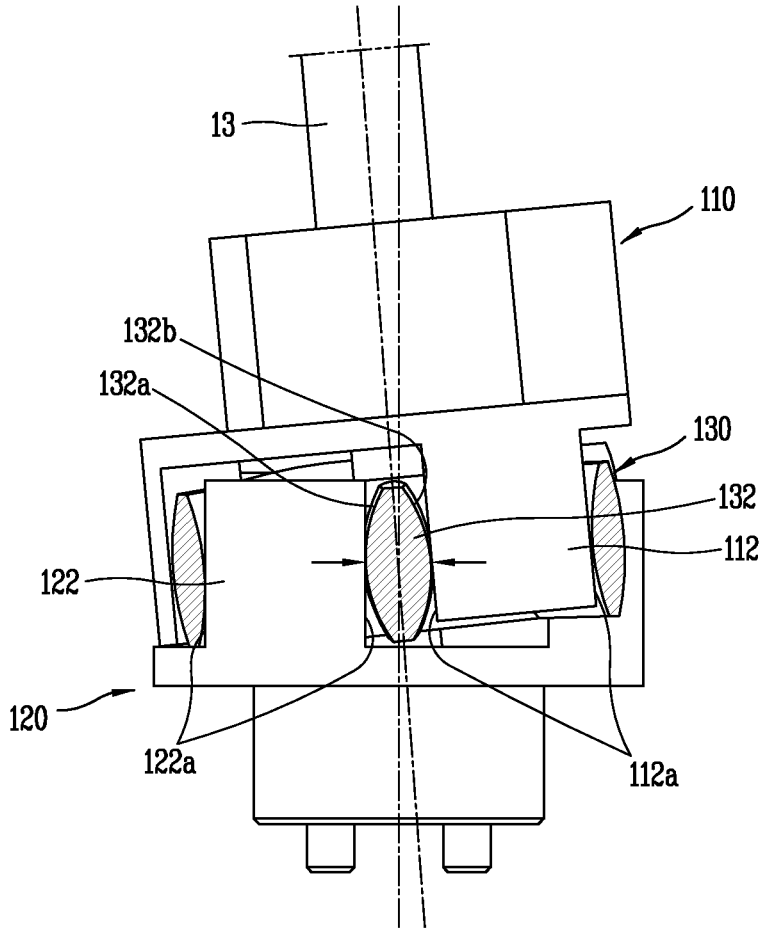
FIG. 7 is a longitudinal sectional view illustrating an assembled state of a coupling assembly in a case where an inner handle and an outer handle assembly of FIG. 5 are not concentric with each other.

FIG. 4 is a disassembled perspective view of a circuit breaker and an outer handle assembly according to the present invention. FIG. 5 is a disassembled perspective view of a coupling assembly of the circuit breaker of FIG. 4. FIG. 6 is a longitudinal sectional view illustrating an assembled state of a coupling assembly in a case where an inner handle and an outer handle assembly of FIG. 5 are concentric with each other. And FIG. 7 is a longitudinal sectional view illustrating an assembled state of a coupling assembly in a case where an inner handle and an outer handle assembly of FIG. 5 are not concentric with each other.

As shown, in a circuit breaker having a coupling device according to the present invention, a circuit breaker body 1 configured to selectively break an electric circuit may be installed in a distribution board. An inner handle 2, configured to manipulate the circuit breaker, may be installed on an upper surface of the circuit breaker body 1. An outer handle assembly 10, configured to manipulate the inner handle 2 from outside, may be installed at a distribution board panel 5.

The outer handle assembly 10 may include a cover 11 installed at the distribution board panel 5; an outer handle 12 rotatably installed at the cover 11, and manipulated by a user from outside of the distribution board panel 5; and a shaft 13 connected to the outer handle 12, and configured to transmit an operation of the outer handle 12 to the inner handle 2.

A coupling assembly 100, configured to transmit a rotational force of the outer handle assembly 10 to the inner handle 2, may be coupled between the outer handle assembly 10 and the inner handle 2.

The coupling assembly 100 may include a first coupler 110 coupled to the shaft 13; a second coupler 120 coupled to the inner handle 2; a third coupler 130 provided between the first coupler 110 and the second coupler 120, and configured to transmit a rotational force applied to the first coupler 110 to the second coupler 120; a coupling spring 140 inserted into the third coupler 130, and configured to allow the first coupler 110 and the second coupler 120 to be positioned on the same shaft as two ends thereof are supported at the first coupler 110 and the second coupler 120; and a coupling bolt 150 configured to couple the first coupler 110 and the second coupler 120 to each other.

Coupling holes 111 and 121 may be penetratingly-formed at the first coupler 110 and the second coupler 120 in a shaft direction, respectively, so that a coupling bolt 150 can be inserted thereinto.

The inner handle 2 and the outer handle assembly 10 may not be concentrically assembled to each other. Accordingly, an inner diameter of the coupling holes 111 and 121 may be formed to be larger than an outer diameter of the coupling bolt 150, so that the first coupler 110 and the second coupler 120 can be restricted by the coupling bolt 150 with a gap therebetween, the gap large enough for the first coupler 110 and the second coupler 120 not to be detached from each other in a shaft direction.

A plurality of coupling protrusions (hereinafter, will be referred to as first coupling protrusions) 112 may be formed at an edge of one side surface of the first coupler 110 in a circumferential direction with a constant gap therebetween. A plurality of coupling protrusions (hereinafter, will be referred to as second coupling protrusions) 122 may be formed at an edge of one side surface of the second coupler 120 in a circumferential direction with a constant gap therebetween. The second coupling protrusions 122 are formed in correspondence to the first coupling protrusions 112, and are configured to transmit a rotational force applied to the first coupler 110 through the shaft 13 to the second coupler 120, by being engaged with the first coupling protrusions 112.

As shown in FIG. 6, the first coupling protrusion 112 and the second coupling protrusion 122 may be formed to have a height high enough for them to overlap each other. The first coupling protrusions 112 may be formed in a circumferential direction with a constant gap therebetween, and the second coupling protrusions 122 may be formed in a circumferential direction with a constant gap therebetween. Sliding protrusions 132 of the third coupler 130 to be explained later are inserted between the first coupling protrusions 112 and the second coupling protrusions 122. A side surface 112*a* of the first coupling protrusion 112 in a circumferential direction may contact one side surface 132*a* of the sliding protrusion 132 in a circumferential direction. A side surface 122*a* of the second coupling protrusion 122 in a circumferential direction may contact another side surface 132*b* of the sliding protrusion 132 in a circumferential direction.

The third coupler 130 may be provided with a body portion 131 for inserting the coupling spring 140 thereinto. The sliding protrusions 132, configured to transmit a rotational force applied to the first coupler 110 to the second coupler 120, may be formed on an outer circumferential surface of the body portion 131. In this case, the sliding protrusion 132 may be inserted into a space between the side surface 112*a* of the first coupling protrusion 112 in a circumferential direction, and the side surface 122*a* of the second coupling protrusion 122 in a circumferential direction. The sliding protrusions 132 may be radially protruding from an outer circumferential surface of the body portion 131 in a circumferential direction, with a constant gap therebetween.

The body portion 131 may be formed in a ring shape, so that the coupling spring 140 can be inserted thereinto. Preferably, the two side surfaces 132*a* of the sliding protrusion 132 in a circumferential direction are formed to have an oval shape. More concretely, the two side surfaces 132*a* of the sliding protrusion 132 of the third coupler 130 in a circumferential direction are preferably formed to always point-contact the first coupling protrusion 112 of the first coupler 110 and the second coupling protrusion 122 of the second coupler 120. Under such configuration, even if the first coupler 110 and the second coupler 120 are not concentric with each other as shown in FIG. 7, the third coupler 130 has the same inclination angle as the first coupler 110. Accordingly, the third coupler 130 can transmit a rotational force applied to the first coupler 110 to the second coupler 120 in a direction perpendicular to a shaft direction of the second coupler.

As shown in FIG. 6, an overlapped length between the first coupling protrusion 112 of the first coupler 110 and the second coupling protrusion 122 of the second coupler 120 in a shaft direction is preferably longer than a contact length between the first coupling protrusion 112 or the second coupling protrusion 122 and the sliding protrusion 132 of the third coupler 130 in a circumferential direction in a shaft direction. That is, as shown in FIG. 6, a length (H1) of the sliding protrusion 132 of the third coupler 130 in a shaft direction may be longer than a length (H2) of the first coupling protrusion 112 and the second coupling protrusion 122 in a shaft direction.

The same components as those of the conventional art are provided with the same reference numerals.

The coupling device for a circuit breaker according to the present invention may have the following effects.

If a user rotates the outer handle 4 in a state where the inner handle 2 and the outer handle assembly 10 have been assembled to each other, a rotational force of the outer handle 4 is transmitted to the shaft 13 and the first coupler 110. Then the rotational force is transmitted to the inner handle 2 via the first coupling protrusions 112 of the first coupler 110, the sliding protrusions 132 of the third coupler 130, and the second coupling protrusions 122 of the second coupler 120, thereby being used to turn on/off the circuit breaker.

As shown in FIG. 6, in a case where the inner handle 2 and the outer handle assembly 10 are concentric with each other, the sliding protrusions 132 of the third coupler 130 transmit a rotational force applied to the first coupling protrusions 112 of the first coupler 110, to the second coupling protrusions 122 of the second coupler 120, in a direction perpendicular to a shaft direction of the second coupler. Accordingly, a user's force to rotate the outer handle can be transmitted to the inner handle 2.

On the other hand, as shown in FIG. 7, even in a case where the inner handle 2 and the outer handle assembly 10 are not concentric with each other, one side surface 112*a* of the first coupling protrusion 112 of the first coupler 110 in a circumferential direction point-contacts one side surface 132*a* of the sliding protrusion 132 of the third coupler 130 in a circumferential direction. At the same time, one side surface 122*a* of the second coupling protrusion 122 of the second coupler 120 in a circumferential direction point-contacts another side surface 132*b* of the sliding protrusion 132 of the third coupler 130 in a circumferential direction. Accordingly, the third coupler 130 transmits a rotational force applied to the first coupler 110 to the second coupler 120 in a direction perpendicular to a shaft direction of the second coupler 120, in a state where the third coupler 130 is inclined from an upper surface of the circuit breaker body. As a result, a user's force to rotate the outer handle 12 can be transmitted to the inner handle 2.

A coupling assembly according to another embodiment of the present invention will be explained as follows.

Figure 8:
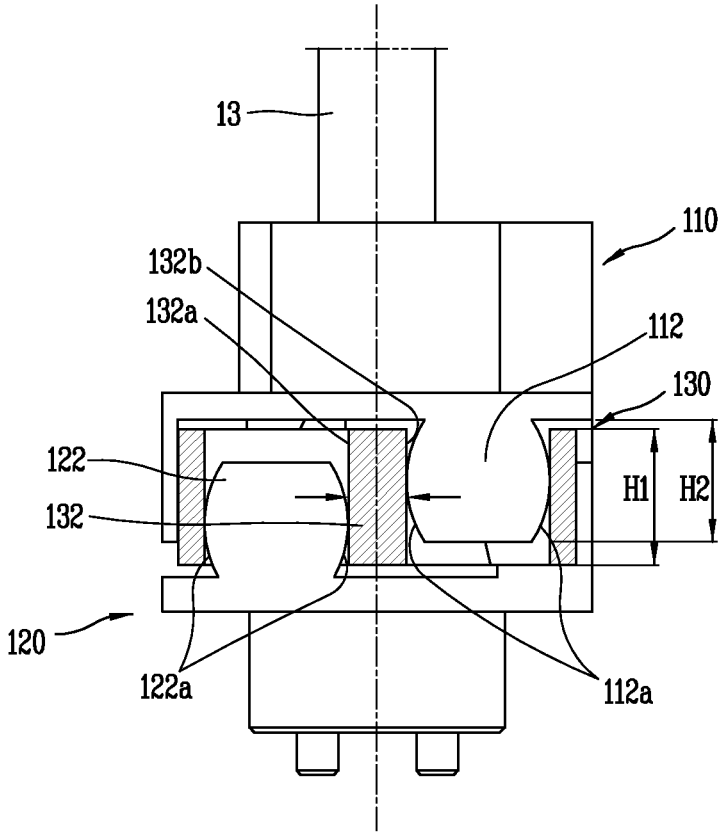
FIG. 8 is a longitudinal sectional view of a coupling assembly of FIG. 6 according to another embodiment of the present invention.

That is, in the aforementioned embodiment, two side surfaces of the sliding protrusion of the third coupler are curved surfaces of an oval shape, whereas a side surface of the first coupling protrusion and a side surface of the second coupling protrusion which contact the two side surfaces of the sliding protrusion are planar surfaces. However, in this embodiment, as shown in FIG. 8, two side surfaces of the sliding protrusion of the third coupler in a circumferential direction are planar surfaces, whereas a side surface of the first coupling protrusion and a side surface of the second coupling protrusion which contact the two side surfaces of the sliding protrusion are curved surfaces.

Even in a case where the inner handle 2 and the outer handle assembly 10 are not concentric with each other, the first coupling protrusion 112 of the first coupler 110 point-contacts the sliding protrusion 132 of the third coupler 130, and the second coupling protrusion 122 of the second coupler 120 point-contacts the sliding protrusion 132 of the third coupler 130. The third coupler 130 may transmit a rotational force applied to the first coupler 110 to the second coupler 120 in a direction perpendicular to a shaft direction of the second coupler, in a state where the third coupler is inclined from an upper surface of the circuit breaker body. As a result, a user's force to rotate the outer handle 12 can be transmitted to the inner handle 2.

Although not shown, even in a case where two side surfaces of the sliding protrusion of the third coupler are curved surfaces, and a side surface of the first coupling protrusion and a side surface of the second coupling protrusion which contact the two side surfaces of the sliding protrusion are also curved surfaces, the aforementioned effects can be obtained.

The aforementioned curved surface may have a circular shape as well as an oval shape.

In the coupling device for a circuit breaker according to the present invention, even if the inner handle and the outer handle assembly are not concentric with each other, the third coupler may transmit a rotational force applied to the first coupler to the second coupler in a direction perpendicular to a shaft direction of the second coupler, in a state where the third coupler is inclined from an upper surface of the circuit breaker body. As a result, a user's force to rotate the outer handle can be transmitted to the inner handle. This can prevent a malfunction of the circuit breaker, and thus can enhance reliability of the circuit breaker.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A coupling device for a circuit breaker, the coupling device comprising:

an outer handle assembly coupled to a shaft and installed at a distribution board;

a circuit breaker body;

an inner handle rotatably installed at the circuit breaker body and configured to manipulate the circuit breaker; and a coupling assembly configured to transmit a rotational force of the outer handle assembly to the inner handle, wherein the coupling assembly includes:

a first coupler coupled to the outer handle assembly, the first coupler comprising one or more first coupling protrusions protruding away from the outer handle assembly along a first shaft-wise direction;

a second coupler coupled to the inner handle, the second coupler comprising one or more second coupling protrusions protruding away from the inner handle in a second shaft-wise direction, wherein the second coupling protrusions interlockingly correspond to the first coupling protrusions and are longitudinally restricted by the first coupler along the second shaft-wise direction;

a third coupler positioned between the first coupler and the second coupler and configured to transmit a rotational force from the first coupler to the second coupler; and a coupling spring configured as a compression coil spring provided between the first coupler and the second coupler, wherein the third coupler comprises:

a body portion formed in a ring shape such that the coupling spring is inserted into the body portion, wherein the body portion is provided at an inner side of an inner circumferential surface of the first coupling protrusions and the second coupling protrusions; and a plurality of sliding protrusions radially protruding from an outer circumferential surface of the body portion, each sliding protrusion disposed between a side surface of a corresponding one of the first coupling protrusions and a side surface of a corresponding one of the second coupling protrusions to transmit the rotational force in a circumferential direction, wherein a first side surface and a second side surface of each of the sliding protrusions are formed as curved surfaces and configured to contact the corresponding side surfaces of the first coupling protrusions and the second coupling protrusions in a circumferential direction.

2. The coupling device for a circuit breaker of claim 1, wherein an overlapped length between a first coupling protrusion and a corresponding second coupling protrusion is greater than a contact length between the first coupling protrusion or the second coupling protrusion and the third coupler.

3. The coupling device for a circuit breaker of claim 2, wherein the first and second side surfaces of each of the sliding protrusions are formed in an oval shape having a long axis and a short axis.

4. The coupling device for a circuit breaker of claim 1, wherein a height of the sliding protrusions is greater than a height of the first coupling protrusions or the second coupling protrusions.

5. The coupling device for a circuit breaker of claim 4, wherein the first and second side surfaces of one of the sliding protrusions are formed to point-contact a corresponding first coupling protrusion and a corresponding second coupling protrusion in a radial direction.

6. The coupling device for a circuit breaker of claim 5, wherein the first and second side surfaces of each of the sliding protrusions are formed in an oval shape having a long axis and a short axis.

7. The coupling device for a circuit breaker of claim 1, wherein the first coupler and the second coupler are coupled to each other by a coupling bolt.

* * * * *